US006314680B1

(12) United States Patent
Buckwalter et al.

(10) Patent No.: US 6,314,680 B1
(45) Date of Patent: Nov. 13, 2001

(54) LOUVRE MECHANISM

(75) Inventors: David Buckwalter, Leichart; Ian Plummer, Russell Lea, both of (AU)

(73) Assignee: Nomad Handicrafts Pty Ltd. (AU)

( * ) Notice: Subject to any disclaimer, the term of this patent is extended or adjusted under 35 U.S.C. 154(b) by 0 days.

(21) Appl. No.: 08/793,246

(22) PCT Filed: Aug. 22, 1995

(86) PCT No.: PCT/AU95/00525

§ 371 Date: Jun. 24, 1997

§ 102(e) Date: Jun. 24, 1997

(87) PCT Pub. No.: WO96/06259

PCT Pub. Date: Feb. 29, 1996

(30) Foreign Application Priority Data

Aug. 22, 1994 (AU) ..... PM 7609

(51) Int. Cl.[7] ..... E06B 7/096
(52) U.S. Cl. ..... 49/82.1; 49/74.1
(58) Field of Search ..... 49/82.1, 336, 403, 49/74.1, 362, 425; 403/298

(56) References Cited

U.S. PATENT DOCUMENTS 5,216,837 * 6/1993 Cleaver et al. ..... 49/82.1
5,379,551 * 1/1995 Swapp ..... 49/82.1
5,469,658 * 11/1995 Digianni et al. ..... 49/82.1
5,537,780 * 7/1996 Cleaver et al. ..... 49/82.1
5,735,762 * 4/1998 Fasterding et al. ..... 403/298
5,806,933 * 9/1998 Tsui et al. ..... 403/298
5,820,288 * 10/1998 Cole ..... 403/298
5,836,823 * 11/1998 Shellaberger ..... 403/298

* cited by examiner

*Primary Examiner*—Jerry Redman
*Assistant Examiner*—Curtis A. Cohen
(74) *Attorney, Agent, or Firm*—Reising, Ethington, Barnes, Kisselle, Learman & McCulloch, P.C.

(57) ABSTRACT

A louvre shutter adapted to be assembled from elements forming a kit. The elements are so adapted that the shutter dimensions can vary, enabling the shutter to be installed within a window frame that falls within a predetermined range of sizes. The side rails of the shutter incorporate elongate channels for receiving elongate support members. The support members have a plurality of apertures that journal elongate pinion gears projecting from the louvres. The combination of the support rails, louvres, and pinion gears forms a sub-assembly that can be received within the side rails and top rails of the shutter frame. The support members include channels that receive gear racks. The pinion gears mesh with the gear racks enabling synchronous rotation of the louvres. The pinion gears perform the additional function of operating as spindles for the louvres. The dual functionality of the pinion gears reduces the complexity of component parts in the kit and facilitates assembly.

14 Claims, 8 Drawing Sheets

LOUVRE MECHANISM

TECHNICAL FIELD

This invention is in the field of moveable louvre structures, particularly but not necessarily window shutters with rotatable louvres.

PRIOR-ART DESCRIPTION

Window shutters incorporating rotatable louvres are a popular alternative to curtains and blinds. This is especially true of wooden shutters.

However shutters incorporating rotatable louvres are involved items to manufacture. All the louvres must be cut to the correct width. They must be evenly spaced within the frame and positioned so that their axes are parallel.

Once this is accomplished, a rod which connects all the louvres together must be accurately positioned on the louvres and neatly stapled in place to effect simultaneous rotation of all louvres.

Once a louvre shutter has been manufactured, its size cannot be altered without substantial reconstruction. This presents the manufacturer with a problem because window dimensions and styles vary greatly from building to building. Window sizes are often non-standard, having been made to measure. Hence a manufacturer utilising present louvre shutter designs must either have a large inventory of stock in order to supply the many variations in window sizes or only manufacture louvre shutters to order.

Unfortunately neither of these options are ideal. A large inventory of stock inflates manufacturing and supply costs. Manufacturing to order significantly increases manufacturers lead time for delivery of the product over an inventory based system.

Economics of manufacturing have dictated that louvre shutter mechanisms be manufactured to order rather than supplied from a large inventory. This stems partly from the implementation of computer aided manufacturing systems. These systems enable the dimensions of the window to be entered so that the various components can be automatically cut to their appropriate sizes. This also enables accurate and even spacing of the louvres within the frame to be achieved relatively easily. Canadian specification CA 2, 063, 632 to DiGianni and Marocco has disclosed such a system which is custom manufactured by computer aided manufacturing.

CA 2, 063, 632 has also addressed a further problem with louvre shutters, namely that the requirement for a connecting rod which is placed in the centre of the louvre mechanism. This rod is difficult to attach and many manufacturers feel that this rod detracts from the aesthetic value of the shutter. CA 2, 063, 632 has proposed the use of a rack and pinion system which is internal to the shutter frame. U.S. Pat. No. 5,216,832 to Lafayette, La May and Dusevic has also addressed this problem and similarly proposes the use of an internal rack and pinion system to facilitate rotation of the louvres.

CA 2, 603, 632 however is specifically directed to a shutter constructed from extruded plastic. It addresses specific problems inherent in the manufacture and supply of such louvre shutters. The ability of this design to be custom manufactured and factory assembled is one of its major advantages according to the authors.

U.S. Pat. No. 5,216,832 is a complex design comprised of many components that would be difficult to manufacture or assemble without the assistance of modern manufacturing facilities.

Neither of these specifications address the problems inherent in present designs that require louvre shutters to be either manufactured to order or that require the manufacturer to have an uneconomically large inventory.

Accordingly it is an object of the present invention to provide a design for a louvre shutter system that is adapted to fit a range of window sizes, that does not require excessive inventories, and that does not need to be manufactured to order.

SUMMARY OF THE INVENTION

According to one aspect of the present invention there is provided a louvre shutter including a plurality of frame members adapted to locate at least one elongate support member with a plurality of apertures; said apertures adapted to axially locate and support at least a first end of a plurality of louvres; at least one gear rack located adjacent said at least one support member and engaged by a plurality of elongate pinion gears each of which is coaxial with one of said apertures and axially with one of said louvres such that said pinion gears are further adapted to operate as spindles for said louvres.

The provision of a support member that serves to support the louvres greatly simplifies constructional requirements as the apertures may be pre-drilled or moulded accurately into position. Preformed holes allow the support member and frame members to be cut to the required length. This construction allows the louvre to be sold in a kit based form as tailoring the louvre to the appropriate size for the window frame is relatively easy.

Provision of an elongate pinion gear further adapted to operate as a spindle simplifies constructional requirements over prior art arrangements.

According to a further aspect the present invention provides a kit arrangement for a louvre shutter mechanism including a plurality of frame members, a plurality of louvres, at least one elongate support member with a plurality of apertures, a plurality of pinion gears and at least one gear rack said frame members, support member, louvres and gear rack adapted such that their length can be altered so that said shutter when assembled can fit a window frame of a size within a predetermined range; said frame members adapted to locate said at least one support member; said at least one gear rack located adjacent said at least one support member and engaged by said pinion gears which are further adapted to operate as pinion gears for said louvres; each said pinion gear being coaxial axially with a first end of one of said louvres and with one of said apertures whereby said apertures support and journal said louvres within said frame members.

The support members provide a kitted louvre mechanism that can be readily assembled by non-professional persons as tolerances required in cutting and drilling are reduced. The support members also allow a hidden rack and pinion system to be incorporated without onerous assembly requirements.

According to a further aspect, the present invention provides a method of assembling a louvre shutter mechanism such that the louvre shutter mechanism can be located within a window frame of a size that is within a predetermined range; said method including the steps of (1) providing a plurality of frame members, a plurality of louvres, at least one gear rack, and at least one support member with a plurality of apertures and a plurality of elongate pinion gears further adapted to operate as pinion gears for said louvres;

(2) adjusting the length of at least said frame members, support member, louvres and gear rack to fit within said window frame;

(3) locating said pinion gears axially with a first end of said louvres;

(4) locating said pinion gears within the apertures of said support members;

(5) locating said gear rack adjacent said support members to engage said pinion gears; and (6) locating the assembly of step (5) within said frame members.

DETAILED DESCRIPTION OF THE PREFERRED EMBODIMENT

The louvre shutter assembly will now be discussed with reference to the drawings. The reader will appreciate that the invention is not limited to the preferred embodiment discussed herein and that variations are possible within the spirit and scope of the invention.

Figure 1:
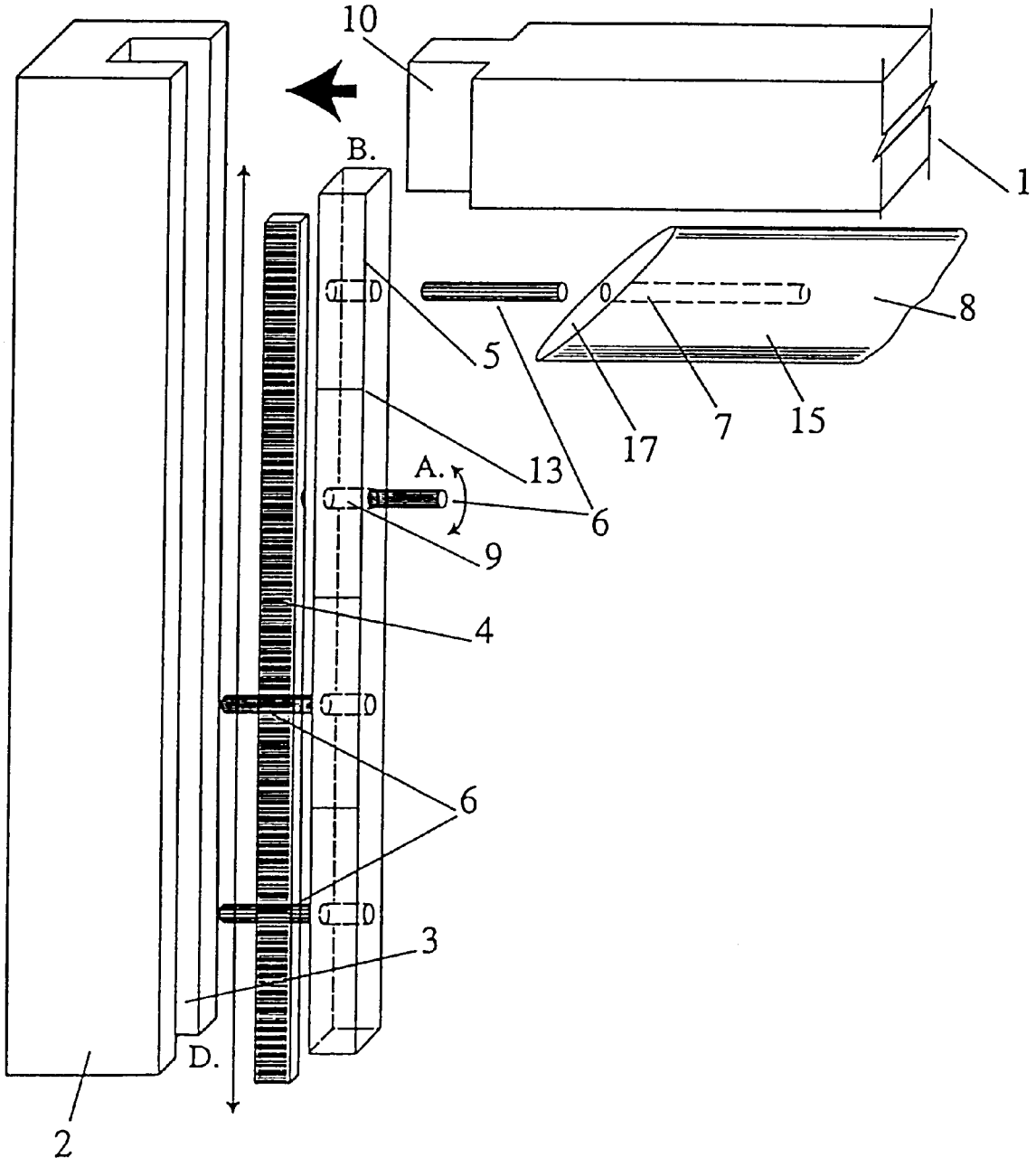
FIG. 1 is an exploded, fragmentary, isometric view of the louvre shutter illustrating partial assembly of the several parts.
Figure 2:
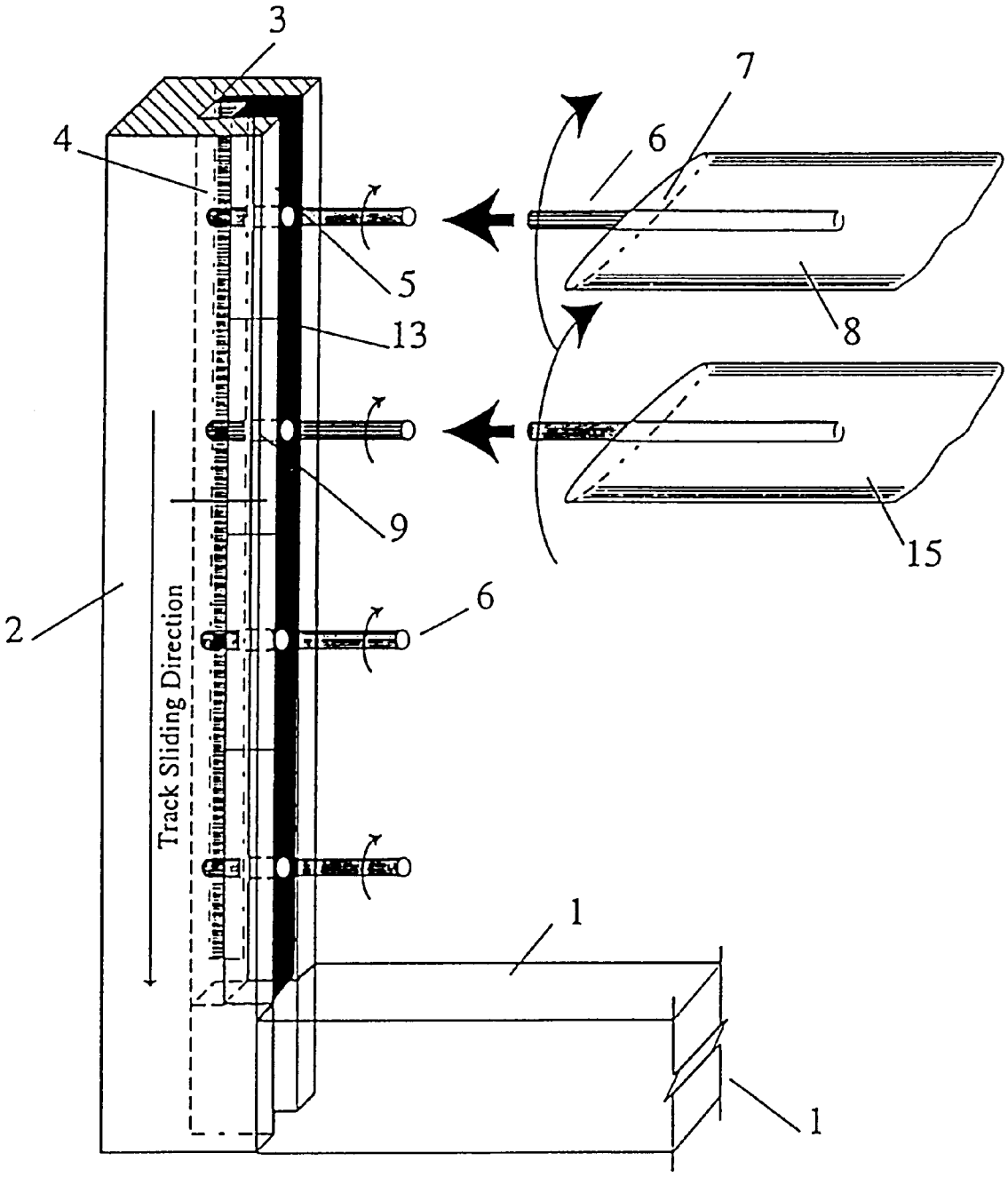
FIG. 2 is a similar view of the louvre shutter further assembled.

FIG. 1 shows two frame members, namely, an end rail 1 and a side rail 2. A longitudinal recess 3 is located in the side rail 2. A toothed gear rack 4 is slideably received within the recess 3 adjacent a support member 5. Elongate toothed pinion gears 6 are embedded in and extend axially beyond the associated louvres 8 and are further adapted to operate as spindles for said louvres. Preferably each pinion gear 6 is located and fixed within axial hole 7 of an associated louvre 8. The pinion gear 6 protrudes from the louvre 8 and is received and journaled within hole 9 of the support member. Each pinion gear 6 protrudes beyond hole 9 of the support member and the teeth of the pinion gears mesh with the teeth of the gear rack 4.

The rack 4 is located within the recess 3 and preferably adjacent the rear wall of the recess and the side wall of the recess. The placement of the gear rack 4 adjacent these walls, under the pinion gears 6 and adjacent the support member enables the rack 4 to be held within the recess 2 without the need for complex retaining mechanisms.

Figure 4A:
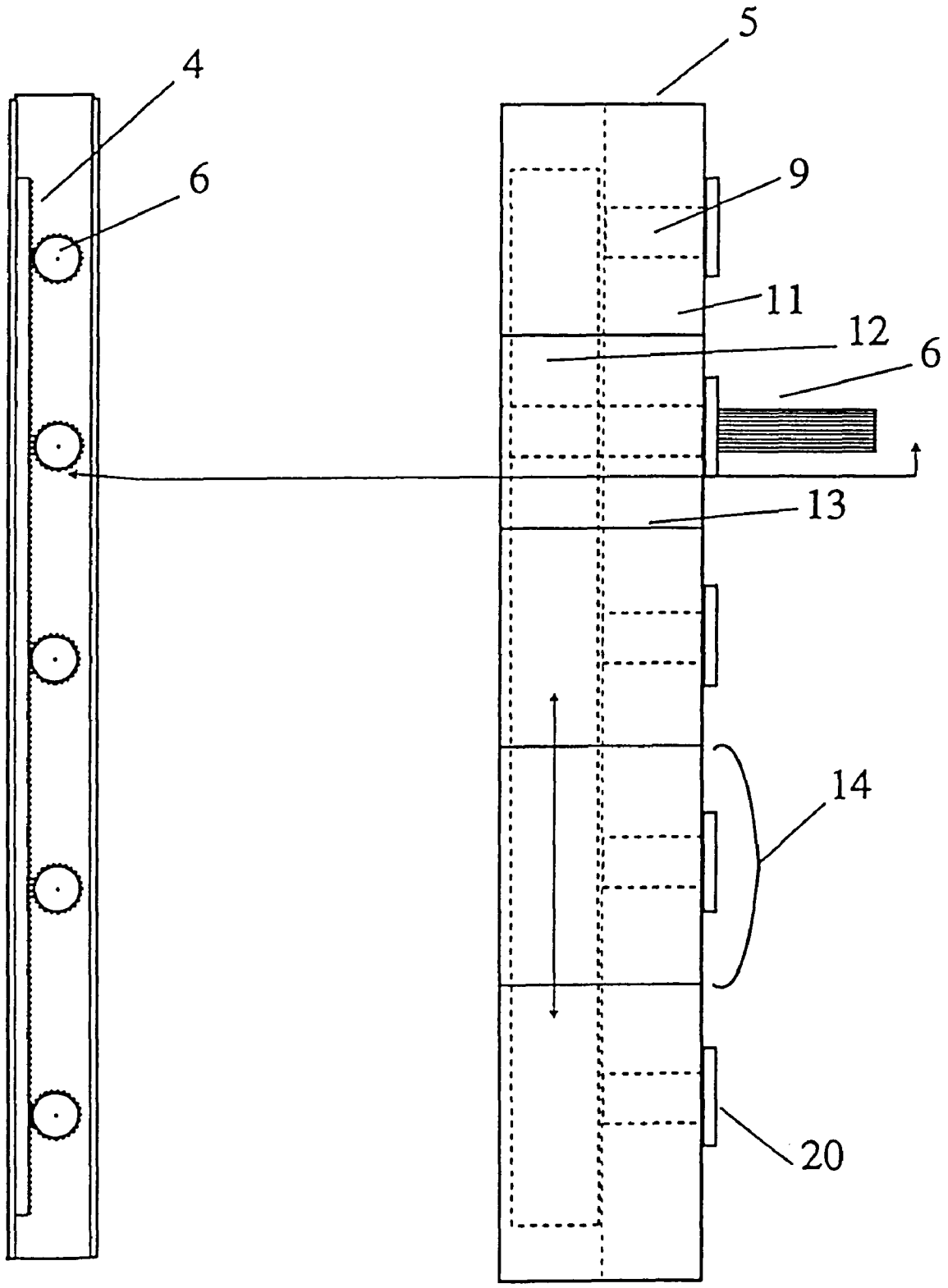
FIGS. 4*a*–4*c* are views similar to FIGS. 3*a* and 3*b* of an alternate support frame member.
Figure 4B:
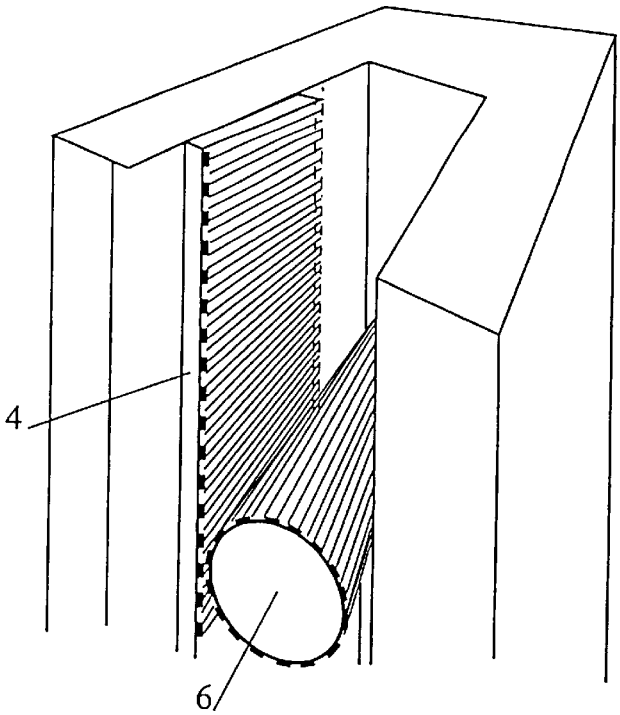
Figure 4C:
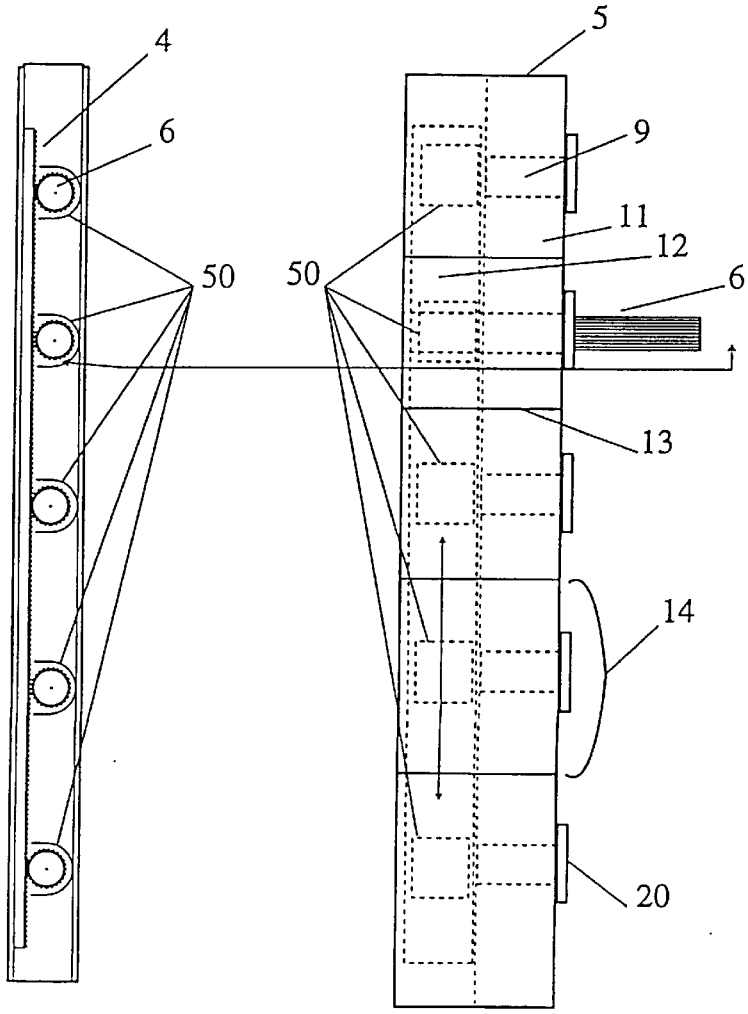

A further embodiment is shown in FIGS. 4*a*–4*c*. It provides the support member 5 with an additional channel portion 12 adjacent apertures 9 of said support member. The gear rack 4 is preferably received within this channel portion 12. The pinion gears 6 extend beyond the associated louvres and through the support member 5 into the cavity created by the channel 12. In this way the pinion gears perform the function of a rotary spindle for said louvres.

With the rack and pinion system, rotation of a louvre causes the pinion gear to rotate which in turn causes the rack to slide within frame channel 3 or channel 12 in the support member. Sliding of the gear rack causes any other pinion gear engaged with the rack to rotate. In this way synchronous rotation of the louvres is achieved.

Locating the gear rack 4 in such a channel 12 simplifies assembly particularly of the kitted embodiment. It enables the pinion gears 6 once located in the louvres 8 to be further located in the support holes 9 and located in engagement with the gear rack 12. This enables construction of a functional sub-assembly louvre mechanism that can be readily located within frame members containing channel portions.

In FIG. 4*c*, a support member 5 with additional channel portion 12 is disclosed, that further includes a part-cylindrical collar mechanism 50. Each of these collars accommodates part of each spindle gear and has an open side which overlies and confronts the rack 4. In operation, the teeth of the spindle gears extend through the open side of the associated collar and mesh with the teeth of the rack. The collars 50 further support the pinion gears 6 against flexing which has been found to occur when the gear rack 4 slides within channel 12. This sliding of the rack in turn bears upon the pinion, which it has been found causes lateral flexing in the gears before rotation occurs. Accordingly the collars 50 are provided to reduce this lateral flexing of the pinion gears so that a more efficient operation results.

Preferably, the inside diameter of the collar is 0.02 mm larger than the outside diameter of the pinion gear, which preferably is 5.54 mm.

In an alternative arrangement of the support member, the channel portion may be located intermediate the aperture of the support member such that the pinion gear is located within an aperture on either side of said gear rack. By supporting the pinion gear on either side of its engagement with the gear rack, lateral flexing will be reduced.

The support member 5 is preferably divided into a plurality of separable sections 14 by separation markings or joints 13. The number of sections preferably corresponds to the number of holes 9 in the support member 5. These markings are preferably used as a guide to cut the support member to the desired length. The holes 9 of the support member 5 are preferably not located centrally within the sections 14, but are offset so that the axis of each hole is closer to one adjacent separation joint than it is to the other adjacent separation joint. Non-central location of these holes enables leading and trailing edge portions of the louvres to abut or overlaps when the louvres are located in the closed position.

Figure 3A:
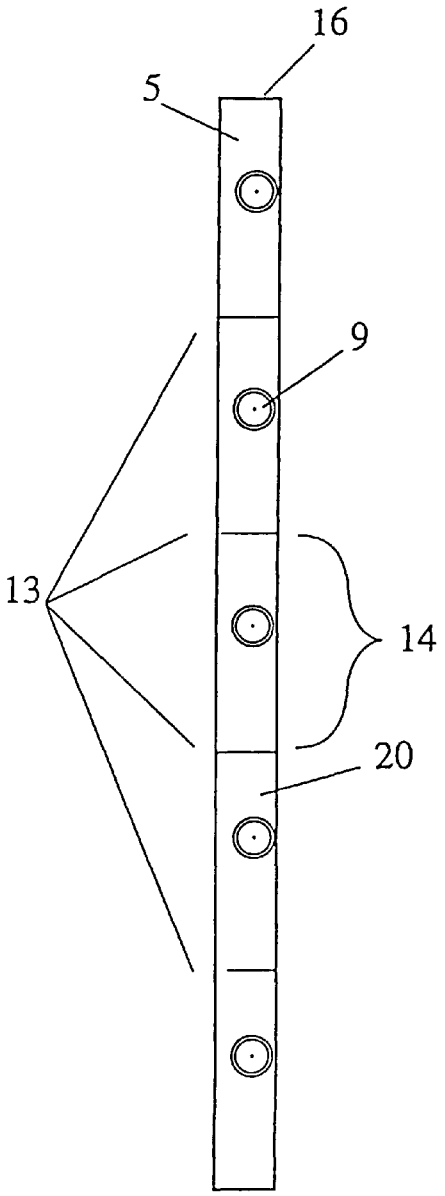
FIGS. 3*a* and 3*b* are side elevational views of side support frame members.
Figure 3B:
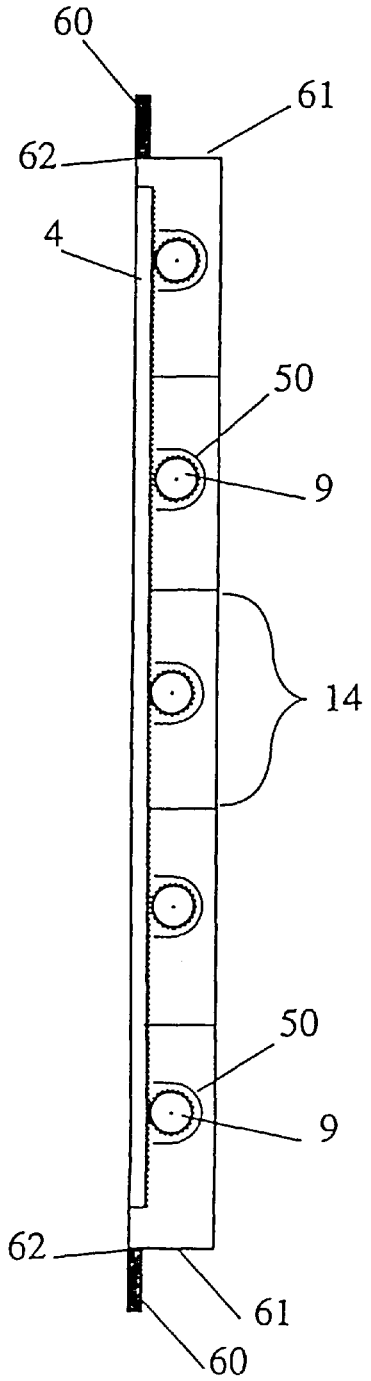

In such an embodiment, offset of these holes 9 from the centre of the section 14 in the support member 5 is determined by the thickness of the end rails 1. The louvre 8 adjacent the end rail 1 needs to be offset slightly so that it does not abut the end rail 1 as it is rotated. The location of these holes 9 and the sections 14 in the support member 5 is shown in FIGS. 3*a*and 3*b*. In the particular embodiment shown the centres of the holes 9 in the support member 5 are 46 mm centre to centre. Each section 14 is therefore 46 mm wide. Each hole 9 is positioned 20 mm from one end each section 14 and 26 mm from the other end. These 46 mm sections will enable a 50 mm louvre 8 to overlap adjacent louvres 8 by 2 mm at either edge 15.

It is preferable that in the kitted embodiment one end of the support member 5 will be marked as a "no cut end" 16. This end is shown in FIG. 3*a*. The section 14 containing the no cut end 16 is 52 mm wide. It contains an offset of 6 mm additional to the 46 mm wide section. Reference to FIG. 3*a* will demonstrate that in this preferred embodiment, louvres 8 adjacent end rails 1, will have their axes positioned some 26 mm from either end rail allowing end louvres to rotate without interfering with the end rails.

An alternative embodiment of the support member 5, depicted in FIG. 3*b*, utilises at least one and preferably two tags 60 instead of a no-cut end 16. In use the tag 60 is folded onto surface 61 via a hinge 62 located (and preferably moulded) at the interface of surface 61 and tag 62. The thickness of tag 60 should be sufficient to provide clearance so that the louvre adjacent the end rail can rotate without interference. With this embodiment aperture 9 can be located centrally within each section 14 of support member 5.

Where the length of the support member 5 is less than the length of the side rail, the tag 60 can be removed so that a number of support members can be located within each side rail 2 of the shutter frame. Where it is desired for all the louvres to operate synchronously, an additional gear rack 4 can span the joints in the support members 5 on one side rail 2 of the frame while the remaining gear racks 4 are located within the support members 5 located within the side rail 2 on the opposite side of the frame. In this way the additional gear racks 4 translate the rotational movement of the louvres within the first support member 5 to the louvres located by the adjacent support members. It is not essential to join the abutting support members 5, as the end rails, when assembled, operate to retain the support members within the channel in the side rail 2.

A further feature that may be incorporated into the support member 5 is the provision of washers 20 (FIGS. 4*a* and 4*c*) around the holes 9 which receive the pinion gears 6. These washers 20 may be additional portions of plastic 20 that are raised off the edge of the support member 5. In such an embodiment, the louvres 8 will abut these raised portions 20 and during rotation the louvres will bear against these raised portions. Being raised these portions 20 will prevent the entire edge 17 of the louvre from wearing against the support member 5.

The frame is preferably comprised of four members, two side rails 2 and two end rails 1. When assembled the side rails 2 are opposing each other and the end rails 1 are opposing each other as demonstrated in FIG. 9. In the kitted embodiment the side rails will be preferably 1 metre long and the end rails will be preferably 0.5 m wide. It is envisaged that a range of kitted embodiments will be employed. Each embodiment will provide side rails of a specific length and end rails of specific width. The range of kits should enable a wide variety of window and other openings to be covered. The length of the support members and the gear racks will preferably be varied according to the length of the side rails.

Alternatively the second side rail may have a recess 3 of narrower depth than the first side rail as this second recess need only accommodate a support member 5. Alternatively it may be of the same depth of the first recess and operate with a gear rack as described above.

The frame preferably utilises mortice and tenon joints. The end rail preferably forms the tenon 10 portion of the joint. Tenon joints 10 are preferably utilised in the kitted embodiment as they may be shaped relatively easily by non-professional persons. This enables the width of the frame to be cut to size by reducing the end rail to the desired length and cutting an additional tenon joint 10 in the end rail.

In the kitted embodiment the recess 3 of the side rails preferably form mortice joints. This enables the side rails 2 to be cut to the desired length with no further shaping required. These mortice joints 3 have the further advantage that they may extend the length of the side rail and correspondingly provide the recess which operates to receive the gear rack and support member. This dual function of the mortice joint further simplifies manufacturing requirements.

The mortice and tenon joints may be simply glued and clamped in place once the remainder of the louvre shutter mechanism has been assembled.

When the frame is assembled each support member 5 preferably abuts both end rails 1 so that it is positively located within the recess 3. The preferred width of the support member 5 is such that it is flush with the external edge of the side rail 2 when located in recess 3. The preferred width and positive location between the end rails prevents the support member from moving within the recess 3, when the frame is assembled. This enables the support member 5 to support the weight of the louvres 8. Preferably the holes 9 in the support member 5 will operate as bearing surfaces for the pinion gears 6. The support member 5 is preferably manufactured of self lubricating plastic, such as self lubricating acetal.

The gear rack 4 is preferably of shorter length than the recesses 3. This is to enable the gear rack 4 to slide within the recess when the louvres are rotated without engaging the end rails 1 of the frame.

Preferably the pinion gears 6 are extruded of slightly flexible plastic such as nylon. This enables the pinion gear to twist should the louvres be rotated beyond any particular stop position of the louvres. In this way the pinion gears 6 perform five functions. They operate as axles for the louvre 8, as anchors for the pinion gears in louvre hole 7, as pinion gears for the rack 4, as bearings within the holes 9 of the support member and as shock absorbers for torsional overload.

When one louvre 8 is manually or otherwise rotated, the pinion gear 6 of that louvre 8 will engage the rack 4 and cause linear movement of the rack 4 within the recess 3. This linear movement will cause the other pinion gears 6 to rotate. This in turn causes the other louvres 8 to rotate. In this way synchronous movement of the louvres 8 is achieved through the rotation of only one louvre 8.

Figure 11:
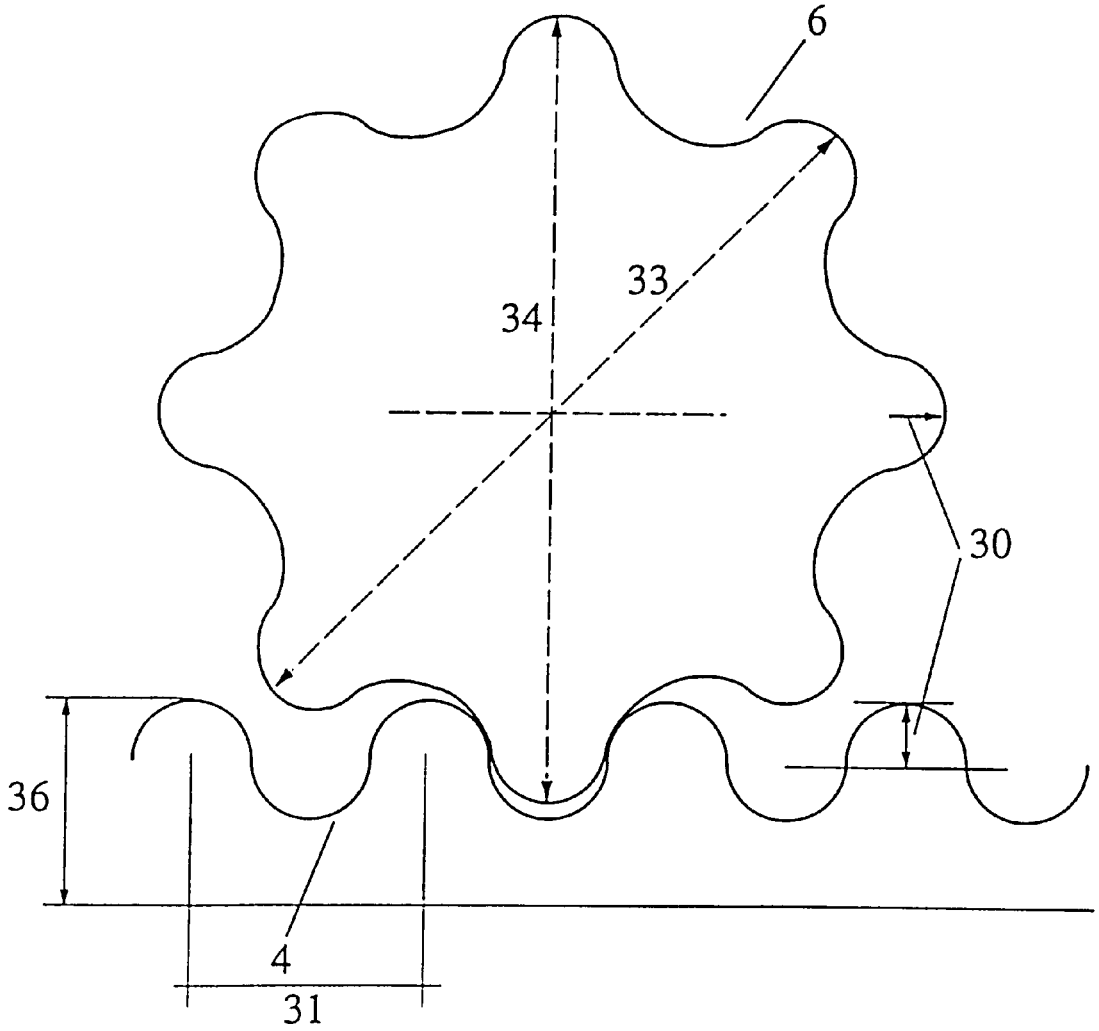
FIG. 11 is a detailed, enlarged side view of the pinion gear and gear rack.

The intermeshing teeth on the gear rack and the pinion gear are preferably continuously curved. This provides the system with smooth operation. The Pinion gear 6 of FIG. 11 is preferably 40 mm long and preferably has an outside diameter 33 of 5.54 mm and the radius from the centre of the pinion gear to the centre of the teeth 34 is preferably 2.20 mm. The gear rack 4 is preferably 9 mm wide with its length shorter than the support member 5 by two or more pitch lengths. The depth 36 of the gear rack 4 is preferably 2.105 mm. The pitch of the rack 4 and pinion gear 6 is preferably 2.3 mm and the radius of each tooth is preferably 0.575 mm.

It is preferable that the rack and pinion gear be manufactured with tolerances of 0.02 mm as the potential movement of up to 0.04 mm between the rack and a pinion gear is magnified by the 25 mm radius of the louvre. With this tolerance it has been found that the magnified movement seen in the louvre is acceptable for quality operation.

Where the second support member 5 does not have an adjacent gear rack 4, the pinion gears projecting into the support member may be cylindrical. In another embodiment an alternative mechanism for allowing rotation of the louvre off the second side rail may be employed. Such a mechanism may locate rotatable pinion gears on the second side rail. Alternatively rotatable pinion gears may be integrally incorporated into a support member.

FIGS. 5 through 9 are the assembly drawings that may accompany a kitted embodiment. These instructions will now be recited with reference to these drawings.

The kit will preferably include components of pinion gear pinions 6, two support members 5, two gear racks 4, louvres 8, two side rails 2 and two end rails 1. The kit will preferably include the following assembly aids: two elastic bands, four G-clamps and one pinion gear inserter and wood glue.

The window or opening onto which the shutter is to be located should first be measured. The shutter may be shortened by removing slats. Firstly calculate the number of slats that need to be removed and cut the support member 5 at the marks 13 placed intermittently on its surface so that the same number of holes 9 remaining in the support member 5 equals the number louvres 8 required. The support member 5 should only be cut from the end indicated. An equivalent length to that removed from the support member 5 should also be removed from the gear rack 4 and the side rails 4.

Where the height is to be adjusted by an amount less than the one louvre, the width of one of the end rails may be reduced.

The width of the shutter may also be reduced. Once the required width is determined, the width of the end rails 1 should be correspondingly reduced. This is best achieved by re-cutting the tenon joint 10. The width of each louvre 8 will also need to be reduced by an equivalent amount.

Figure 9:
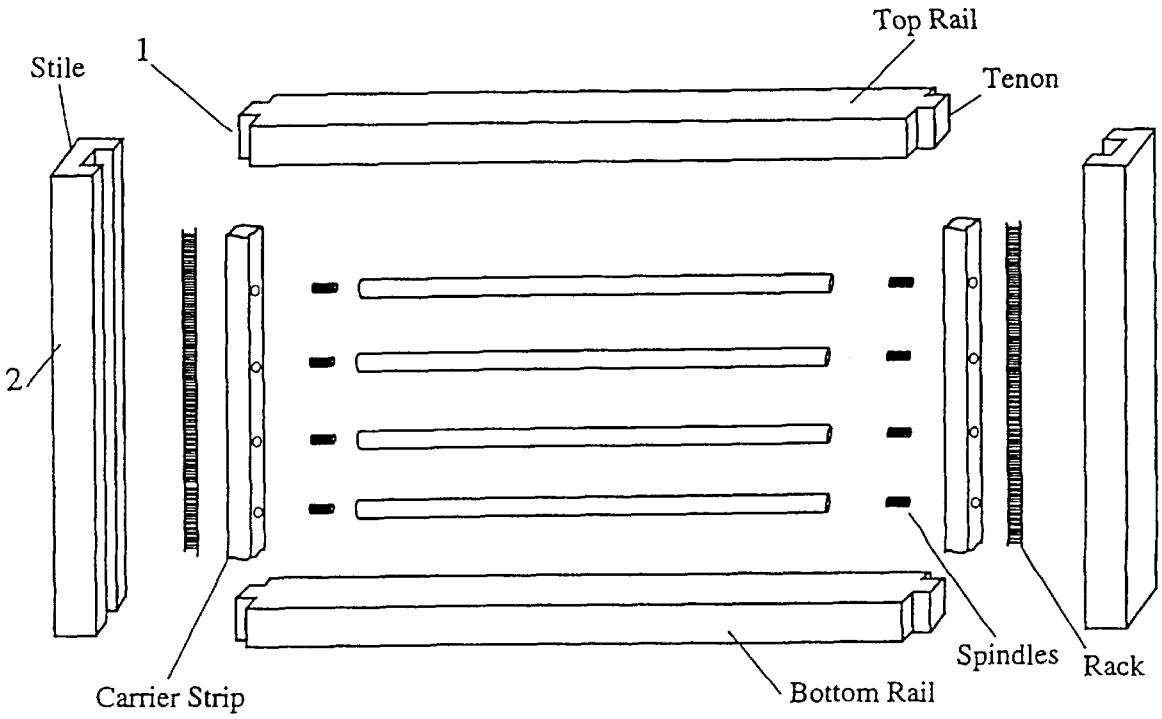
FIG. 9 is an exploded similar view showing the arrangement of the components before assembly.

With reference to FIG. 9, it is preferable that the components be arranged onto a flat surface before commencing assembly of the shutter.

Figure 5:
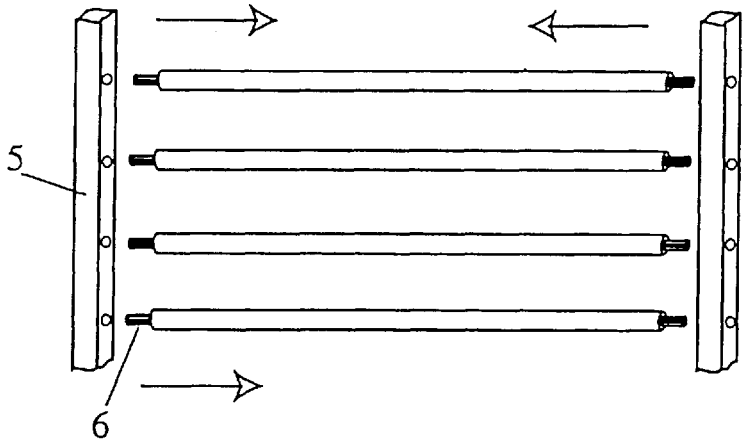
FIG. 5 is an exploded, isometric view showing the support members in relation to the pinion gears of the louvres.
Figure 10:
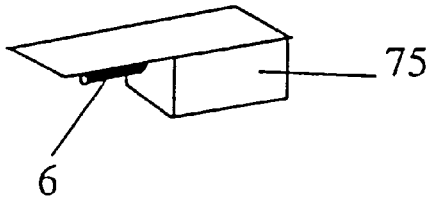
FIG. 10 is an isometric view of a device to assist in correctly locating the pinion gears in the louvres.

With reference to FIG. 5 the first step is to forcibly insert each pinion gear 6 into a pre-drilled hole 7 at each end of each the louvre 8 using the pinion gear insertion aid 75 (FIG. 10). This insertion aid 75 will push the pinion gears 6 into the louvre 8 so that 20mm of pinion gear 6 protrudes from the end of the louvre 8. The insertion aid, is preferably shaped to receive the pinion gear 6. The orientation of the planar portion adjacent the top surface of the insertion aid 75 and the shaped aperture adapted to receive the pinion gear ensures that each gear 6 is located within each louvre with substantailly identical orientation. The support members 5 are then located onto the pinion gears 6.

Figure 6:
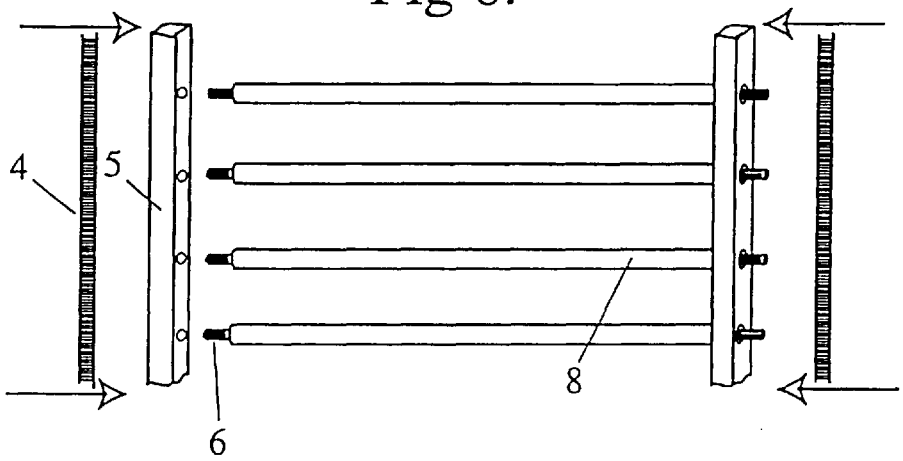
FIG. 6 is a view similar to FIG. 5 but showing the pinion gears being located with reference to the gear rack.
Figure 7:
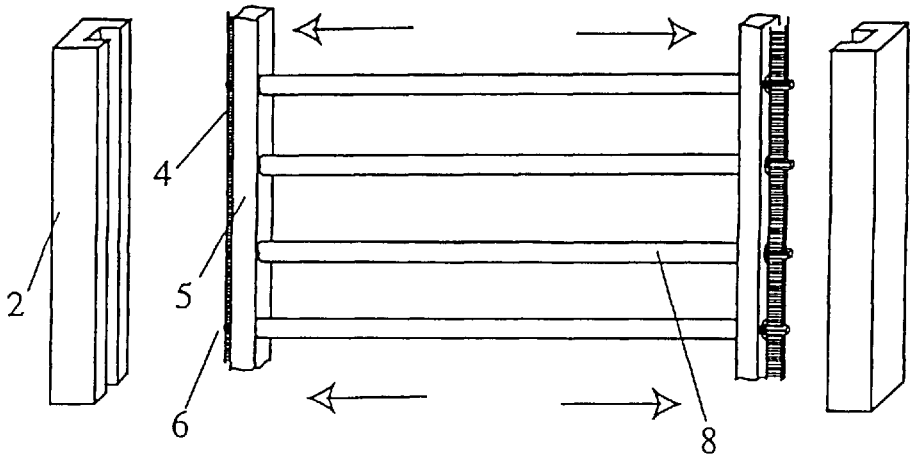
FIG. 7 is a similar view showing the assembled louvres and gear rack being located in the recess of the side rails.

With reference to FIG. 6, stage 2 of the assembly procedure, the second step is to ensure that the louvres 8 are in the open position and at right angles to the support member 5 and the work surface. This is best achieved by elevating the support member 5 off the work surface, so that the louvres can be aligned relative to the surface preferably in a vertical orientation.

The gear racks 4 are now located onto the pinion gears 6. Preferably the gear rack 4 is located equidistant from each end of each support member 5. This is best achieved by keeping the support members 5 elevated and resting the tooth side of the gear rack 4 on end of the pinion gears 6, ensuring that the teeth of the pinion gears engage the teeth of the rack.

In this way a self supporting sub-assembly consisting of the support members, louvres, pinion gears (and gear rack where support members include channel 12) is provided. This sub-assembly can then be located within side rails 2.

Figure 8:
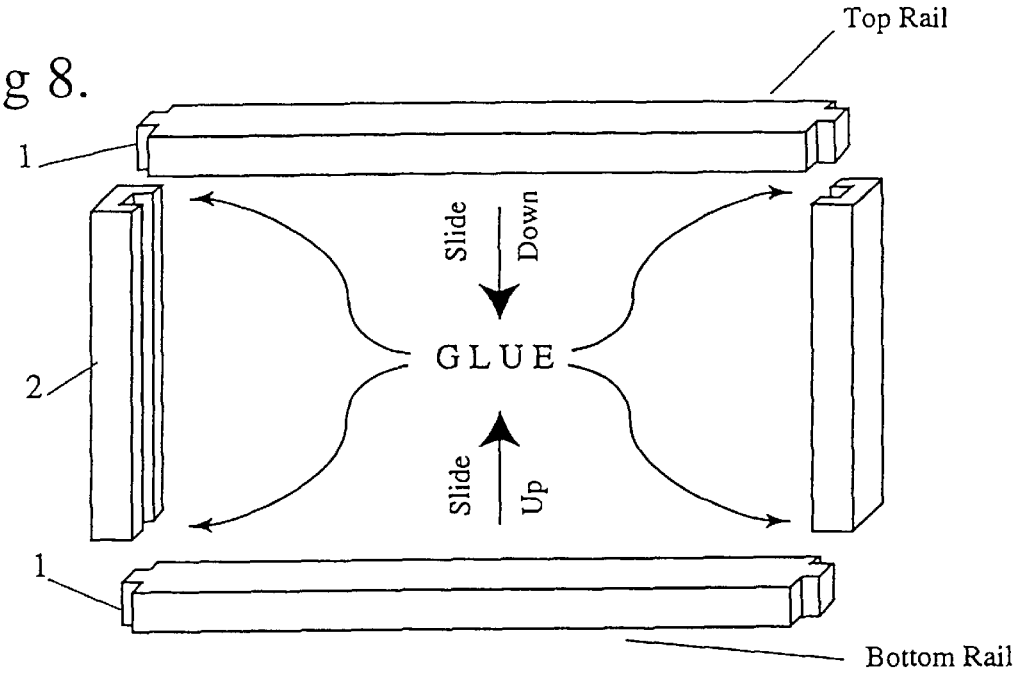
FIG. 8 is an exploded, isometric view showing the arrangement of the frame members.

With reference to FIG. 8, the end rails 1 may now be located into place. The tenons 10 of the end rails are aligned with the recesses 3 of the side rails 2. The end rails 1 are slid into place until they are aligned with the side rails 2. In this position, the support member 5 should be firmly located between the end rail 1 and bottom rail 2 and retained laterally within the recesses 3.

Affixing the frame members using suitable means and glue will lock the sub assembly into place without use of separate affixing means.

What is claimed is:

1. A louvre shutter assembly kit including a plurality of frame members, a plurality of louvres, first and second support members having a plurality of uniformly and correspondingly spaced apertures, a plurality of pinion gears and at least one gear rack, said frame members, said support members, said louvres and said gear rack being so constructed and arranged that said shutter when assembled can fit a window frame of predetermined size, said frame members being configured to accommodate said support members, said gear rack being operatively located adjacent said first support member and engaged by one end of said pinion gears, said gears, having teeth located at both ends thereof and being operable as spindles for said louvres, each of said pinion gears being fixed at the other end to a first end of one of said louvres and extending axially through one of said apertures of said first support member whereby said first support member supports and journals said louvres within said frame members.

2. A kit as claimed in claim 1 further including a second plurality of pinion gears, each of said second plurality of pinion gears being fixed to a second end of said louvres and extending axially through one of said apertures in said second support member.

3. A kit as claimed in claim 2 further including a second gear rack operatively located adjacent said second support member and wherein said second plurality of pinion gears are of such length as to engage said second gear rack.

4. A kit as claimed in claim 3 wherein said louvres, said first and said second support members, said pinion gears and said gear racks form a self supporting sub-assembly.

5. A kit as claimed in claim 1 wherein at least one of said support members includes an elongate channel portion adjacent said apertures, said channel portion operatively maintaining said gear rack within said member in mesh with said pinion gears.

6. A method of assembling a louvre shutter mechanism such that the louvre shutter mechanism can be located within a window frame, said method including the steps of:

(1) providing a plurality of frame members, a plurality of louvres, at least one gear rack, and first and second support members each having a plurality of apertures and a plurality of elongate pinion gears, which have teeth located at each end of each pinion gear, and are operable as spindles for said louvres;

(2) adjusting the length of said frame members, said support members, said louvres and each said gear rack to fit within said window frame;

(3) securing one of said pinion gears at each end of each of said louvers;

(4) extending said pinion gears axially through the apertures of said first and second support members;

(5) arranging each said gear rack adjacent one of said support members in a position in which each of said gear racks engages said pinion gears; and (6) placing the arrangement of step (5) within said frame members.

7. A method of assembling a louvre shutter as claimed in claim 6 further including the steps of:

(11) providing a second gear rack; and

(12) locating said second gear rack adjacent said second support member.

8. A louvre shutter assembly adapted to be mounted in an opening in a wall of a building, said assembly comprising:

a. a plurality of spaced apart frame members joined to one another and forming an open space;

b. a plurality of elongate louvres each of which substantially spans said space;

c. a spindle fixed to and extending beyond each of said louvres at opposite ends thereof, each spindle at one end of each of said louvres having unitary pinion gear teeth extending substantially the entire length of said spindle;

d. first and second support members carried by said frame members journaling said spindles for rotation about spaced apart, parallel axes;

e. a toothed rack supported by one of said frame members for sliding movements in each of two opposite directions, said rack having its teeth in mesh with those of each of those spindles having teeth whereby sliding movement of said rack in one direction effects concurrent rotation in the same direction of all of said louvres about their respective axes, and f. said louvres together being of such length and width as substantially to fill said space when said louvres are rotated to a corresponding selected position.

9. A louvre shutter assembly as claimed in claim 8 wherein said louvres, said first and second support members, said first and second plurality of pinion gears and said gear racks form a self-supporting sub-assembly, said frame members receiving said sub-assembly thereby forming said shutter assembly.

10. The assembly according to claim 8 wherein the width of each of said louvres is such that when said louvres are in said selected position their adjacent edges overlap.

11. The assembly according to claim 8 wherein the support members have separation joints on opposite sides of each axis of rotation of said louvres, each of said axes being closer to an adjacent one of the joints than to the adjacent other of the joints.

12. A louvre shutter assembly as claimed in claim 11 wherein at least one of said first and second support members includes an elongate channel portion adjacent said apertures, said channel portion locating said gear rack within said member in engagement with either the first or second plurality of pinion gears.

13. The assembly according to claim 8 including a collar for each toothed spindle carried by said support member and through which each toothed spindle extends, each said collar having an open side overlying and confronting said rack, the teeth of each toothed spindle extending through the opening in the associated collar and meshing with said rack.

14. A louvre shutter assembly adapted to be mounted in an opening in a wall of a building, said assembly comprising:

a. a pair of parallel frame members having a space therebetween;

b. a plurality of louvres each of which spans the space between said pair of frame members;

c. a support carried by one of said frame members and having a plurality of spaced openings therein;

d. an elongate, toothed pinion gear spindle secured to and extending beyond one end of each of said louvres, each said pinion gear spindle extending rotatably through and jounaled in one of the openings in said support for rotation about an axis;

e. a spindle secured to and extending beyond the opposite end of each of said louvres and mounting the associated louvre on the other of said frame members for rotation about said axis;

f. a rack mounted in said one of said frame members for reciprocable linear movements relative thereto, g. said rack and each of said pinion gear spindles having meshed teeth whereby linear movement of said rack effects concurrent rotation of all of said louvres in the same rotary direction ; and h. a collar for each pinion gear spindle carried by said support and through which the associated pinion gear spindle rotatably extends, i. each of said collars having an open side overlying and confronting said rack and through which teeth of each associated pinion gear spindle extends for meshing engagement with teeth of said rack, j. said louvres together being of such length and width as substantially to fill said space when said louvres are rotated to a corresponding selected position.

* * * * *